United States Patent [19]

Knierimen et al.

[11] Patent Number: 4,457,368

[45] Date of Patent: Jul. 3, 1984

[54] SHEARABLE NO GO INSERT FOR A WELL LOCK

[75] Inventors: Jeffrey L. Knierimen, Stafford; Mark S. Fuller, Houston, both of Tex.

[73] Assignee: Camco, Incorporated, Houston, Tex.

[21] Appl. No.: 478,741

[22] Filed: Mar. 25, 1983

[51] Int. Cl.[3] ..... E21B 23/02

[52] U.S. Cl. ..... 166/217; 166/317; 285/3

[58] Field of Search ..... 166/217, 209, 317, 382; 285/2, 3, 4, 422

[56] References Cited

U.S. PATENT DOCUMENTS

| | | | |
|---|---|---|---|
| 3,169,786 | 2/1965 | Cator | 285/3 |
| 3,863,715 | 2/1975 | Yonker | 166/217 |
| 4,254,829 | 3/1981 | Watkins | 166/217 X |

OTHER PUBLICATIONS

Camco General Equipment Catalog 1976-1977, pp. 1199-1200.

*Primary Examiner*—James A. Leppink
*Assistant Examiner*—Thuy M. Bui
*Attorney, Agent, or Firm*—Fulbright & Jaworski

[57] ABSTRACT

An improved no go shoulder on a well lock which is adapted to lock in a locking notch in a landing nipple in a well in which the lock includes a setting wedge to be moved, after shearing setting shear means, for actuating locking dogs into the locking notch. The no go shoulder is of a shearable material having a shear strength load capacity greater than the shear strength capacity of the setting shear means but having a shear strength capacity less than the shear strength capacity of the landing nipple shoulder whereby the strength of the no go is sufficient to allow the lock to be set but is insufficient to deform the landing nipple shoulder. Preferably, the no go shoulder is a shearable insert positioned in a recess in the lock.

5 Claims, 3 Drawing Figures

SHEARABLE NO GO INSERT FOR A WELL LOCK

BACKGROUND OF THE INVENTION

It is conventional to set a lock in a landing nipple in a tubing string in a well. A landing nipple includes a notch for receiving locking dogs from a lock and a landing shoulder which protrudes into the landing nipple bore for contacting a no go shoulder on the lock for allowing a downward force to be applied to the lock for actuating the locking dogs outwardly into the locking notch. However, after the lock is set, any high downward force in the well bore on the lock creates an enormous force per unit area on the landing shoulder of the nipple. This creates the possibility that the landing shoulder of the nipple is deformed and may create burrs which may tear up and damage the sealing packing of subsequent locks and well equipment. Or the lock may wedge in the bore of the nipple and be difficult to retrieve. Also, because of the close tolerances involved in using landing nipples, particularly where a plurality of stair stepping sized nipples are used at different locations in the well bore, the landing nipple landing shoulder size may become deformed to an extent to stop and set a well lock at an unintended location. The landing nipple, if damaged, cannot be easily replaced as it requires pulling the entire well tubing to insert a new landing nipple.

The present invention is directed to providing a no go shoulder on the lock that will not deform the landing shoulder of the nipple.

SUMMARY

The present invention is directed to the improvement in the no go shoulder of a well lock adapted to lock in a locking notch in a landing nipple having a landing shoulder in a well. The lock includes a setting wedge to be moved, after shearing setting shear means, for actuating locking dogs into the locking notch. The no go shoulder of the lock, which engages the landing shoulder, is of a shearable material having a shear strength load capacity greater than the shear strength load capacity of the setting shear means but less than the shear strength load capacity of the landing nipple shoulder. Thus the strength of the no go shoulder is sufficient to allow the lock to be set but is insufficient to deform the landing nipple shoulder.

A still further object of the present invention is wherein the no go shoulder is a shearable insert positioned in a recess in the lock. Preferably the recess includes a space for receiving sheared material.

Still a further object of the present invention is wherein the no go shoulder is of a shearable insert positioned in the lock body and supported at each end and is of a material having a shear strength capacity greater than the setting shear means whereby the strength of the no go is sufficient to allow the lock to be set. However, the insert is of a strength capacity less than the nipple shoulder whereby the no go shoulder may be sheared without deforming the landing nipple shoulder thereby allowing the expanded dogs to hold the lock.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

While the shearable no go insert of the present invention may be used in various types of well locks, for purposes of illustration only, and not as a limitation, the present invention will be described as used in a type DB lock sold by Camco, Incorporated.

Figure 1:
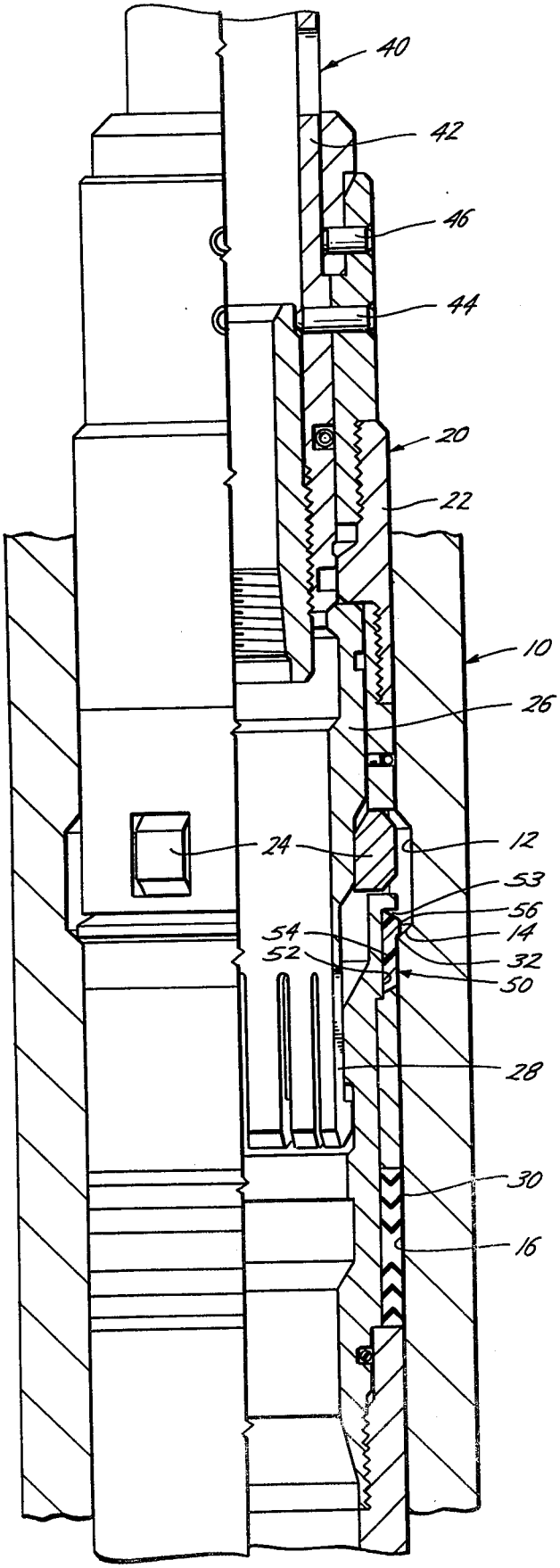
FIG. 1 is a fragmentary elevational view, partly in cross section, illustrating the well lock of the present invention in a running position in a landing nipple prior to locking.

Referring now to the drawings and particularly to FIG. 1, the reference numeral 10 generally indicates a landing nipple positioned in a production tubing in a well such as a type DB landing nipple sold by Camco, Incorporated. The landing nipple 10 includes a locking notch 12 for receiving locking dogs of a lock, and a landing shoulder 14 which protrudes out into the bore of the nipple 10 for engaging a no go shoulder on a well lock for stopping the downward movement of a well lock through the nipple 10, and a polished bore 16 for coacting with a packing seal on a well lock.

The well lock generally indicated by the reference numeral 20 includes a housing or body 22, a plurality of locking dogs 24 which are in the retracted position, as shown in FIG. 1, when the well lock 22 is moved downwardly through the well tubing and into the landing nipple 10, a collet setting wedge 26 initially held in the upward or retracted position relative to the housing 22 and the dogs 24 by collet fingers 28, and a packing seal 30. The housing 22 conventionally includes a no go shoulder 32 integral with the housing 22 for engaging the landing shoulder 14 for allowing the collet wedge 26 to be moved downwardly relative to the housing 22 and actuating the dogs 24 into a locking relationship with the locking notch 12.

Figure 2:
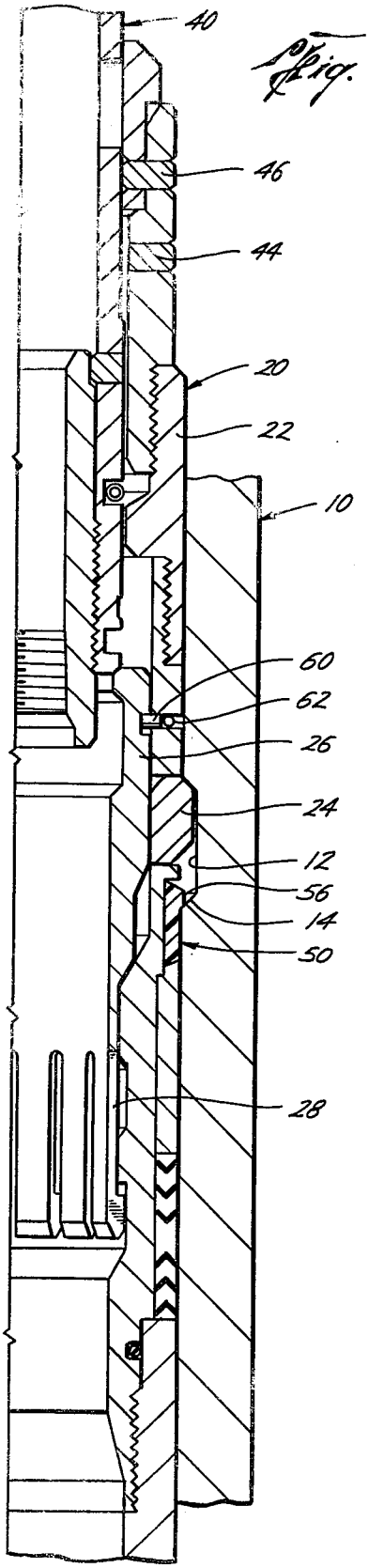
FIG. 2 is a fragmentary elevational view, in half section, of the well lock in the present invention locked in a landing nipple.

In order to actuate the well lock 20, a setting tool generally indicated by the reference numeral 40 such as a Z-6 running tool sold by Camco, Incorporated may be utilized. The running tool 40 includes a plunger member 42 for acting on the top of the collet setting wedge 26 for driving the collet wedge downward and setting the dogs 24. Initially, the running tool 40 is connected to the well lock 20 by one or more shear pins 44 which initially keep the plunger 42 from being actuated until the no go shoulder 32 reaches the landing shoulder 14. Thereafter, downward movement of the plunger 42 will shear the pins 44 allowing the dogs 24 to be set, as best seen in FIG. 2. Additionally, one or more shear pins 46 is provided between the setting tool 40 and the lock 20 which can be sheared after the lock 20 is set in the landing nipple 10 for releasing the running tool 40 from the set well lock 20.

The above general description of a well landing nipple 10, well lock 20 and setting tool 40 is well known.

However, a problem has existed because of the small contact area between the setting shoulder 14 of the landing nipple 10 and the no go shoulder 32 of the well lock 40. While the set dogs 24, as best seen in FIG. 2, prevent the well lock 20 and any equipment connected therebelow from moving uphole, the no go shoulder 32 prevents the well lock 20 from moving downhole. However, enormous forces may be exerted on the well lock 20, either pressure or mechanical, attempting to move the well lock 20 downwardly. But the contacting area between the no go shoulder 32 and the landing shoulder 14 is small and the no go shoulder 32 may deform the landing shoulder 14. This can create burrs on the landing shoulder 14 which will tear up or damage seals 30 on subsequently set locks 20. Deformation of shoulder 14 may possibly increase or decrease the internal diameter of the landing shoulder 14. This could cause a lock to wedge in the bore of the nipple 10 or adversely affect and stop an undesired well lock 20 in a stair stepping installation having a plurality of landing nipples 12 with selectively sized landing shoulders 14 for installing a coacting sized well lock 20.

By way of example only, in a four and one-half inch DB lock, the outside diamter of the no go shoulder 32 is 3.855 inches and the internal diameter of the landing shoulder 14 is 3.813 inches. Therefore, the area of contact between the no go shoulder 32 and the landing shoulder 14 is only 0.25 square inches. With this small area of contact, only a small force is required to damage or deform the landing shoulder 14.

The present invention is directed to providing a shearable no go insert in the housing 22 of the well lock 20. Thus, a shearable insert 50 is provided which is positioned in a recess 52 in the housing 22. Thus, the base 54 of the insert 50 is supported and backed up by the housing 22 but the no go shoulder 56 extends outwardly from the base 54 to make contact with the landing shoulder 14. The no go shoulder 56 of the insert 50 is of a suitable shearable material which has a shear strength load capacity greater than the shear strength capacity of the setting shear means or shear pins 44 whereby the strength of the no go shoulder 56 is sufficient to allow the lock to be set. However, the shear strength capacity of the no go shoulder 56 is less than the shear strength capacity of the landing nipple shoulder 14 whereby the no go shoulder 56 may be sheared without deforming the landing nipple shoulder 14. The insert 50 is made of any suitable plastic or metal with the desired shear strength. A plastic sold under the trademark "RYTON" is satisfactory. Preferably, the recess 52 includes a space 53 positioned above the insert 50 to aid in receiving any material sheared from the insert 50.

In one example using four shear pins 44 of brass having an outside diameter of 3.12 inches, the total shear stress of the pins, which is equal to one-half of their yield strength, was calculated to be 5350 pounds. With the area of the shearable no go shoulder 56 being 0.25 inches, the no go shoulder 56 is selected to shear on a downward force of 10,700 pounds. This is above the shear stress of the pins 44 but considerably below the shear stress of the shoulder 14. Therefore, the yield of the material for the insert 50 must have a yield strength greater than 21,400 pounds per square inch. In this particular illustration it is recommended that the material selected for the insert 50 have a yield strength of approximately 28,450 pounds per square inch for a 70% factor of safety.

Figure 3:
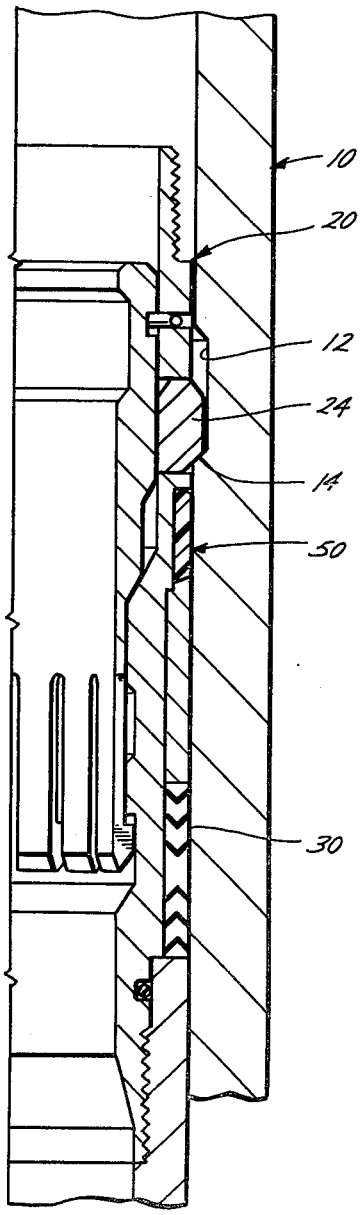
FIG. 3 is a fragmentary elevational view, in half section, showing the well lock locked in a landing nipple and the no go shoulder sheared.

In FIG. 1, the well lock 20 is run downhole through the well tubing and landing nipple 10 by the setting tool 40. When the no go shoulder 56 engages the landing shoulder 14 in the nipple 10, the retracted locking dogs 24 are aligned with the locking notch 12. Further downward movement of the setting tool 40, such as by jarring, will shear the pins 44, move the plunger, 42 downwardly causing the collet setting wedge 26 to move downwardly, engage the dogs 24, and actuate the dogs 24 to the setting position as best seen in FIG. 2. The collet setting wedge 26 remains seated behind the dogs 26 by virtue of the collet fingers 28 engaging the housing 22 and by a shear pin 60 held in place by a garter spring 62. The well lock 20 is now locked in place in the nipple 10. An upward jar may now be taken on the setting tool 40 to shear the release pin 46 and allow the setting tool 40 to be removed from the well lock 20. As seen in FIG. 2, the dogs 24 are in the locking notch 12 and restrain upward movement of the well lock 20, but do not damage the coacting surfaces of the notch 12 as there is a large area contact between the dogs 24 and the notch 12. The set well lock 20 is restrained against downward movement by the engagement of the no go shoulder 56 with the landing shoulder 14. However, since the insert 50 is shearable, any predetermined force in the downward direction, either by pressure or mechanically, will cause the no go shoulder 56 to be sheared, as best seen in FIG. 3, whereby the dogs 24 restrain the well lock 20 from either upward or downward movement. Since the area of contact of the dogs 24 relative to the locking notch 12 and its shoulders are much greater than the area of the no go shoulder 56, the shoulders on the landing nipple 10 are not damaged.

After the well lock 20 has served its purpose, it can be removed by a conventional pulling tool such as a PRS tool by Camco, Incorporated, which grips the inside of the collet wedge 26 and removes it from behind the dogs allowing the dogs 24 to be retracted. The lock 20 is then returned to the well surface and the insert 50 is replaced and the lock 20 is again usable.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. In a well lock adapted to lock in a locking notch in a landing nipple in a well in which the lock includes a no go shoulder for contacting a landing nipple shoulder for allowing a setting wedge to be moved, after shearing setting shear means, for actuating locking dogs into the locking notch, the improvement in the no go shoulder comprising, said no go shoulder being of a shearable material having a shear strength load capacity greater than the shear strength load capacity of the setting shear means but less than the landing nipple shoulder whereby the strength of the no go is sufficient to allow the lock to be set but is insufficient to deform the landing nipple shoulder.

2. The apparatus of claim 1 wherein the no go shoulder is an insert positioned in a recess in the lock.

3. The apparatus of claim 1 wherein the no go shoulder is a plastic.

4. In a well lock adapted to lock in a locking notch in a landing nipple in a well in which the lock includes a no go shoulder on the lock body for contacting a landing nipple shoulder for allowing a setting wedge to be moved, after shearing setting shear means, for actuating locking dogs outwardly into the locking notch, the improvement in the no go shoulder comprising, said no go shoulder being of a shearable insert positioned in the lock body and supported at each end and being of material having a shear strength load capacity greater than the shear means whereby the strength of the no go is sufficient to allow the lock to be set but is of a strength less than the nipple shoulder whereby the no go shoulder may be sheared without deforming the landing nipple shoulder thereby allowing the expanded dogs to hold the lock.

5. The apparatus of claim 4 wherein the no go shoulder is an insert positioned in a recess in the lock with a space provided in the recess above the insert for receiving sheared materials.

* * * * *

UNITED STATES PATENT OFFICE

CERTIFICATE OF CORRECTION

Patent No. 4,457,368 Dated July 3, 1984

Inventor(s) Jeffrey L. Knieriemen and Mark S. Fuller

It is certified that error appears in the above-identified patent and that said Letters Patent are hereby corrected as shown below:

Correct spelling of "Jeffrey L. Knierimen" is:

JEFFREY L. KNIERIEMEN

Signed and Sealed this

*Twenty-sixth* Day of *February 1985*

[SEAL]

*Attest:*

DONALD J. QUIGG

*Attesting Officer* *Acting Commissioner of Patents and Trademarks*